US008485788B2

(12) United States Patent
Arikawa et al.

(10) Patent No.: US 8,485,788 B2
(45) Date of Patent: Jul. 16, 2013

(54) ROTOR FOR STEAM TURBINE AND METHOD OF MANUFACTURING THE SAME

(75) Inventors: Hideyuki Arikawa, Mito (JP); Akira Mebata, Kitaibaraki (JP); Masahiko Arai, Hitachinaka (JP); Yoshitaka Kojima, Hitachi (JP); Haijime Toriya, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 1365 days.

(21) Appl. No.: 11/917,547

(22) PCT Filed: Jun. 9, 2006

(86) PCT No.: PCT/JP2006/311577

§ 371 (c)(1),
(2), (4) Date: Dec. 14, 2007

(87) PCT Pub. No.: WO2006/134831

PCT Pub. Date: Dec. 21, 2006

(65) Prior Publication Data

US 2009/0311103 A1 Dec. 17, 2009

(30) Foreign Application Priority Data

Jun. 17, 2005 (JP) ..... 2005-177112

(51) Int. Cl.
*F01D 5/06* (2006.01)
*F01D 25/00* (2006.01)

(52) U.S. Cl.
USPC ..... 416/244 A; 415/199.5; 415/216.1; 428/683; 428/685

(58) Field of Classification Search
USPC .. 415/199.4, 199.5, 200, 216.1, 229; 416/241 R, 244 R, 244 A; 428/683, 685
See application file for complete search history.

(56) References Cited

U.S. PATENT DOCUMENTS

| | | | | |
|---|---|---|---|---|
| 4,504,554 | A | 3/1985 | Yoshioka et al. | |
| 5,939,215 | A * | 8/1999 | Andler | 428/653 |
| 6,190,124 | B1 | 2/2001 | Freling et al. | |
| 6,234,755 | B1 | 5/2001 | Bunker et al. | |
| 6,398,504 | B1 * | 6/2002 | Arai et al. | 416/241 R |

FOREIGN PATENT DOCUMENTS

| | | |
|---|---|---|
| EP | 1 798 302 A1 | 6/2007 |
| JP | 57-137456 | 8/1982 |
| JP | 57-165603 | 10/1982 |
| JP | 61-112702 A | 5/1986 |
| JP | 6-272503 | 9/1994 |
| JP | 11-229810 | 8/1999 |
| JP | 2001-173405 | 6/2001 |
| JP | 2004-100645 | 4/2004 |
| JP | 2004-256903 | 9/2004 |

OTHER PUBLICATIONS

"Damage on Rotor Journal" Kanazawa, et al, Thermal Power Generation, vol. 23, No. 5, May 1972, pp. 536-542.

* cited by examiner

*Primary Examiner* — Christopher Verdier
(74) *Attorney, Agent, or Firm* — Mattingly & Malur, P.C.

(57) ABSTRACT

A steam turbine rotor shaft and method of manufacturing the same are provided wherein the sliding characteristics of a journal are improved, and the journal is free from welding cracks and does not need a post heat treatment. The low alloy steel coating layer having better sliding characteristics than 9 to 13% Cr heat resisting steel and an area rate of defects including pores and oxides in a range of 3 to 15% is formed by a high velocity flame spray coating method on a sliding surface of the journal.

3 Claims, 4 Drawing Sheets

ROTOR FOR STEAM TURBINE AND METHOD OF MANUFACTURING THE SAME

BACKGROUND OF THE INVENTION

1. Field of the Invention

The present invention relates to a rotor for a steam turbine and a method of manufacturing the same.

2. Description of the Related Art

Since 9-13% Cr content group heat resisting steels (for example, there are steels of 11% Cr—1% Mo—0.6% Ni—0.7% Mn—0.2% V—0.3% Si—0.2% C—0.1% Nb—0.06% N—the balance being Fe all by weight, and steels of 11% Cr—2.6% W—0.2% Mo—2.5% Co—0.5% Ni—0.5% Mn—0.2% V—0.05% Si—0.1% C—0.1% Nb—0.03% N—0.02% B—the balance being Fe) have high temperature strength and low temperature toughness, they have drawn attention as a material for high and intermediate pressure rotors of a steam turbine, and their use is expanding. Because the turbine rotors that rotate at a high speed are supported by a sliding bearing, sliding characteristics of the rotor material influence endurance of the bearing part.

Although 9-13% Cr heat resisting steels have excellent mechanical properties as a rotor material, the sliding characteristics are poor. It is reported that a destructive accident at a position between a journal part and a bearing metal tends to occur (Non-patent document No. 1).

Particularly, so-called "wire wool damage" tends to occur wherein the surface of the journal is scraped leaving fine stripes as if the surface were machine-worked, and there is damage wherein coil-form fine lines in generated foreign matter are found.

A cause of the damage in the journal is thought to be the inclusion of foreign matter between the journal and the bearing metal. Especially, since the 9-13% Cr heat resisting steel has small thermal conductivity, local sticking may occur when the foreign matter enters. Further, since the amount of Cr is large, Cr carbides may be produced when the temperature elevates at the time the foreign matter enters so that the carbides become another foreign matter, which promotes further damage of the journal.

In order to prevent the damage of the journal of the steam turbine rotor made of 9-13% Cr heat resisting steel, there was proposed a method wherein a deposit welding layer of low alloy steel with a small amount of Cr is coated on the journal alloy (Patent document No. 1).

Further, there was proposed a method wherein the deposit welding layer is composed of upper and lower layers, in which the lower welding layer has a lower tensile strength and a larger coefficient of thermal expansion than those of the upper welding layer so that a residual stress remaining in the welding layers is made small (Patent document No. 2).

Patent document No. 1: Japanese patent laid-open 57-137456

Patent document No. 2: Japanese patent laid-open 06-272503

Non-Patent document No. 1: "Damage in Journal", Thermal Power Plant, Vol. 23, No. 5, pp. 536-542, published May 1972

However, in the case where the low alloy steel contains a smaller amount of Cr and has better sliding characteristics than the 9-13% Cr heat resisting steel, since the thermal expansion coefficient of the 9-13% Cr heat resisting steel is smaller than that of the low alloy steel, there remains a tensile residual stress in the surface of the deposit welding layer.

Accordingly, there were problems that cracks tend to occur in the deposit welding layer or welding heat-affected zones, etc. at the time of welding, post heat treatment, usage or in service.

In the methods which employ the deposit welding, a Cr content of the deposit welding layer increases due to dissolution of Cr (dilution) at welding from the base material, i.e., 9-13% Cr heat resting steel.

Therefore, it is necessary to make a thickness of the welding layer such that the surface of the welding layer is not affected by the dilution, which, on the other hand, may cause welding cracks.

In addition, the thick deposit welding and post heat treatment make the process expensive and not productive.

SUMMARY OF THE INVENTION

The present invention was thus conceived to provide a steam turbine rotor made of 9-13% Cr heat resisting steel and a method of manufacturing the turbine rotor wherein the rotor with improved sliding characteristics, does not generate welding cracks and has no need of post heat treatment.

The present invention is featured by a steam turbine rotor made of 9-13% Cr heat resisting steel wherein a coating of a low alloy steel containing Cr of 3 wt % or less is formed on a sliding surface of the journal.

ADVANTAGES OF THE PRESENT INVENTION

According to the present invention, it is possible to improve sliding characteristics of the journal of the steam turbine rotor made of 9-13% Cr heat resisting steel.

EXPLANATION OF REFERENCE NUMERALS

1; rotor, 2; journal, 3; sliding surface of the journal, 4; mother material, 5; low alloy steel coating layer, 10; spray gun, 21; rotor shaft of an electric rotating machine, 22; ball-and-roller bearing, 23; shaft, 24; sliding bearing, 25; testing journal, 26; base, 31; diameter of the shaft, 32; groove depth, 33; groove angle, 41; first bearing, 42; second bearing, 43; thrust bearing, 44; high pressure partition plate, 45; high pressure blade, 46; high pressure inner nozzle, 47; high pressure outer nozzle, 48; turbine rotor shaft, 49; main steam entrance port, 50; high pressure steam discharge port.

DESCRIPTION OF THE PREFERRED EMBODIMENTS

The present invention is mainly featured by forming a coating layer of a low alloy steel being better in sliding characteristics than 9-13% Cr heat resisting steel, containing Cr of 3 wt % or less and an area rate of defects including voids and oxides in an arbitrary cross section thereof being 3-15%, on a sliding surface 3 of a journal 2 of a steam turbine rotor shaft 1 made of the 9-13% Cr heat resisting steel, by a method of high velocity flame spray method (HVOF; high velocity Oxy-Fuel).

Figure 1:
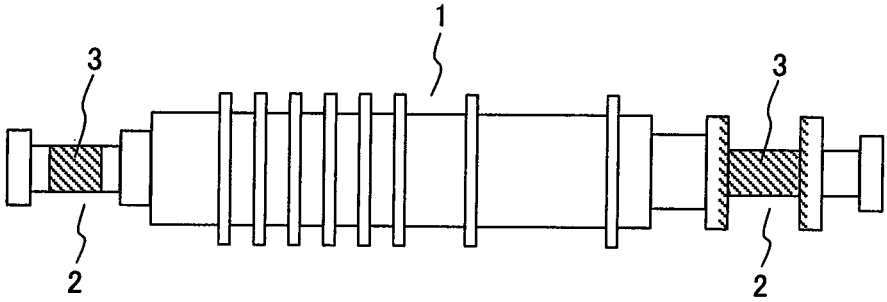
FIG. 1 is a schematic view of an example of a steam turbine rotor according to the present invention.

The steam turbine rotor 1 (FIG. 1) of the present invention made of 9-13% Cr heat resisting steel is provided with the low alloy steel coating layer on the journal surface 3 in order to improve sliding characteristics of the journal surface 3 by the high velocity spray method, which is employed in place of the conventional deposit welding for forming the deposit welding layer on the journal surface 3.

It is possible to form the low alloy coating with a very low thermal energy, compared with the conventional deposit welding method.

In addition, in the high velocity spray coating method, since powder particles are collided against an object with high velocity to form the coating, a compression residual stress remains in the coating surface. Accordingly, the steam turbine rotor made of the 9-13% Cr heat resisting steel hardly generates cracks in the low alloy steel coating layer and may eliminate post heat treatment.

Further, the thickness of the low alloy steel coating layer can be made thin, because there is no dilution of Cr from the base material.

In addition, since there are defects in an area rate of 3 to 15% in the arbitrary cross section, these work as a lubricant holding layer thereby to improve sliding characteristics of the journal.

The purpose of improving the sliding characteristics of the journal of the steam turbine rotor made of the 9-13% Cr heat resisting steel was realized by the high velocity flame spray method with a low thermal energy thereby to achieve high reliability in a simple way, compared with the conventional deposit welding method. The method of the present invention may eliminate the cracks in the coating and post heat treatment.

The steam turbine rotor made of the 9-13% Cr heat resisting steel is provided with the low alloy steel coating layer formed on the surface of the journal so that the sliding characteristics are remarkably improved.

The low alloy steels utilized in the present invention contain preferably 3 wt % or less of Cr. A reason is that if the amount of Cr exceeds 3 wt %, the sliding characteristics may be degraded to reduce a thermal conductivity.

More concretely, there is a low alloy steel containing 0.5 to 2.5% of Cr—0.4 to 1.1% of Mo, the balance being Fe or a low alloy steel containing 2.0 to 2.5% of Cr—0.9 to 1.1% of Mo—0.3% or less of V, the balance being Fe. These low alloy steels have balanced coating strength and sliding characteristics, but the coating material is not limited to the above steels. Persons skilled in the art may select other appropriate materials based on their experience and knowledge.

A thickness of the coating of the low alloy steel is preferably 0.5 to 5 mm. The reason for that is that if the thickness were less than 0.5 mm, the surface of the 9-13% Cr heat resisting steel may be exposed within a short period of time when foreign matter, etc. is included in the sliding portions, and the coating is subjected to abrasion. This is a problem for achieving the long service life of the rotor shaft.

On the other hand, if the thickness exceeds 5 mm, the compression residual stress, which is an advantage of the high velocity flame spray method, decreases gradually, and cracks or peeling off of the coating may take place in the coating.

In the low alloy steel coating layer of the present invention, the thickness of the spray coating itself is an effective coating thickness because there is no influence by the dilution of Cr from the base material, which was observed in the conventional deposit welding method, and effects of the coating are achieved by a ½ or less thickness of the conventional deposit welding coating. Accordingly, it is not economical to form an excessively thick coating, because it tales a long time to perform the process.

The low alloy steel coating layer should preferably contain defects including pores and oxides and an area rate in an arbitrary cross section should preferably be 3 to 15%.

Figure 3:
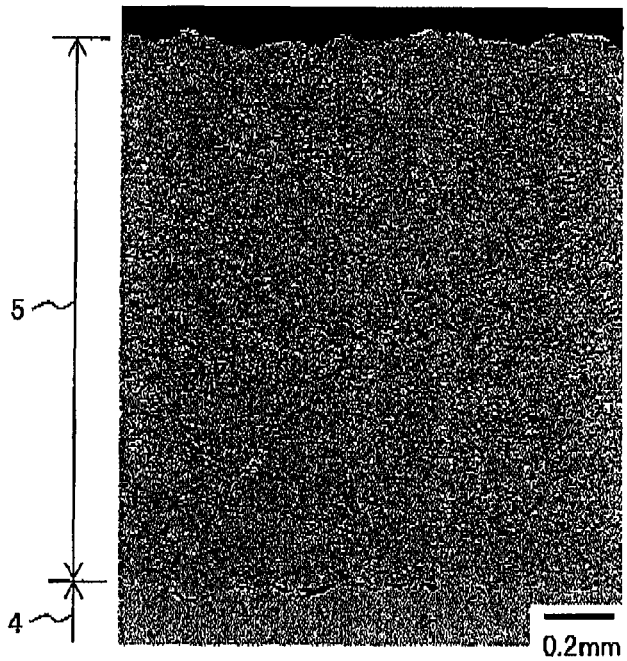
FIG. 3 is a photograph of structure of a cross section of the coating made of the low alloy steel according to the present invention.

FIG. 3 shows an example of a microscopic photograph of the low alloy steel. The coating 5 having a thickness of about 1.5 mm, which is made of the low alloy steel coating is formed on the base material 4 of the 9-13% Cr heat resisting steel. Black network patterns are found in the low alloy element coating 5 in the sectional structure photograph. The patterns are of defects formed in the spray coating layer, the defects being pores and/or oxides (Fe oxides, small amounts of alloy element oxides other than Fe) formed on the surface of the powder of the low alloy steel during the time that the powder particles fly in the high velocity flame when the low alloy steel layer 5 is formed by the high velocity flame spray coating method. The area rate of the defects (the network patterns) in the sectional area of the coating was measured by an image analysis to be about 10%.

Because these defects including oxides and pores function as fine pores in the coating, they store a lubricant therein. As a result, the coating hardly generates lubricant loss and prevents sticking.

However, if the defect rate increases excessively, strength of the coating layer decreases and the peeling-off of the coating or destruction in the coating layer may take place, while the lubricant holding function increases.

Accordingly, the lubricant holding effect is insufficient if the defect rate is less than 3%, but if the defect rate exceeds 15%, reduction in strength of the coating layer takes place.

On the other hand, strength of the coating layer depends on a status or distribution structure of the defects. Even if the defect rate is the same, strength of the coating is higher if fine defects are homogeneously dispersed than in the case where coarse defects are partially or locally deposited. Thus, a strength of 40 MPa or more is preferable. If the strength is less than 40 MPa, peeling-off of the inner destruction of the coating layer tend to take place.

As is described, the most preferable coating layer of the low alloy steel for the steam turbine rotor made of the 9-13% Cr heat resisting steel should have a Cr content of 3% by weight or less, a thickness of 0.5 to 5 mm, the area rate of defects including pores and oxides in an arbitrary sectional structure is 3 to 15%, and a peeling-strength is 40 MPa or more.

The high velocity flame spray coating method is most preferable for forming the above-described coating layer. In other coating methods such as a plasma spray coating method, flame spray coating method, arc spray coating method, etc., material (powder or wire) is melted at high temperature and sprayed to rapidly quench and solidify the sprayed material thereby to form a coating layer. On the other hand, in the high velocity flame spray coating method, powder is sprayed at a high velocity to form a coating layer by utilizing plastic deformation of the base material and powder at collision caused by dynamic energy of the powder.

Due to the difference in the coating forming principle, it is possible to suppress oxidation of the powder in the high velocity spray coating.

In addition, in the methods wherein the coating material is quenched and solidified on the substrate, a residual tensile stress is generated in the resulting solidified coating layer. On the other hand, because plastic deformation of the materials at the time of collision of the material caused by dynamic energy is utilized, residual compression stress remains in the coating layer. As a result, the coating layer of the high velocity spray coating is excellent in adhesion strength and strength of the coating, and hardly generates cracks and peeling-off.

Example 1

Figure 4:
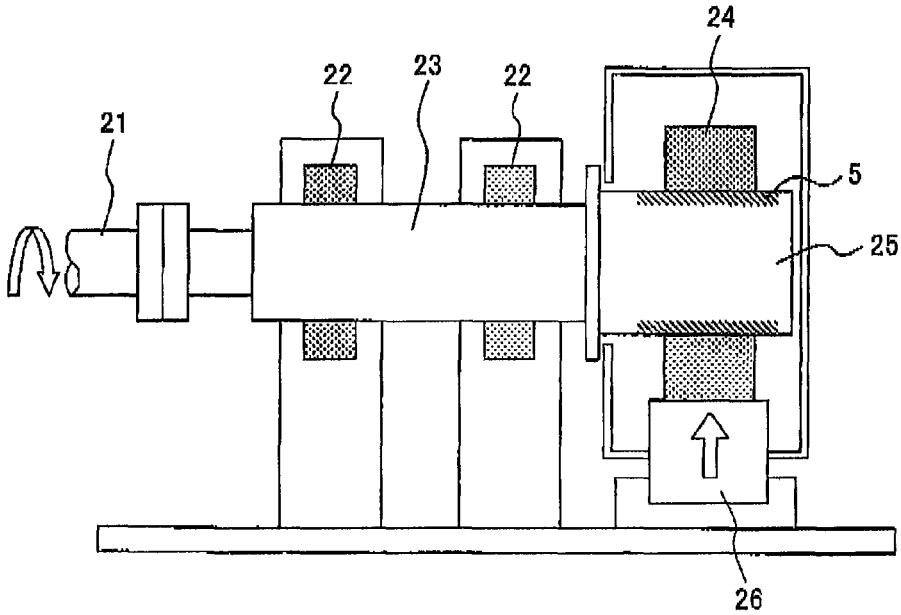
FIG. 4 is a diagrammatic view of a bearing test apparatus according to the present invention.

FIG. 4 shows a schematic view of a sliding testing device for evaluation of the low alloy element coating layer. The device has a sliding testing section constituted by a testing journal 25 disposed at one end of a shaft 23 supported pivotally on two rolling bearings 22 and a sliding bearing 24.

Lubricant is supplied from a lubricant supply mechanism (not shown) to the sliding bearing 24. The sliding bearing 24 is fixed on a base 26, which is capable of up and down movement. The other end of the shaft 23 is connected to a rotary shaft 21 of an electric rotating machine (not shown), thereby to rotate the shaft 23. The bearing test is carried out wherein the device imparts a suitable surface pressure to a sliding face between the test journal 25 and the sliding bearing 24 by lifting the base 26.

A low alloy steel coating 5 was formed on the test journal of a rotor shaft made of 12% Cr heat resisting steel having a composition of 12% of Cr—2.6% of W—0.2% of Mo—2.5% of Co—0.5% of Ni—0.5% of Mn—0.2% of V—0.05% of Si—0.1% of C—0.1% of Nb—0.03% of N—0.02% of B, the balance being Fe.

Figure 5:
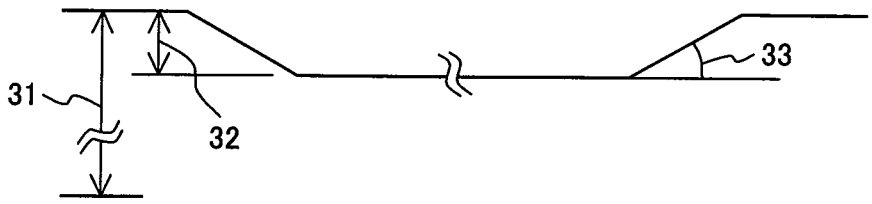
FIG. 5 is a first step of the coating method of the low alloy steel according to the present invention.

At first, as shown in FIG. 5, a groove having a depth 32 of 2 mm was formed in the test journal 25. Both ends of the groove had an inclined angle 33 of 30°.

The purpose of forming the inclined groove walls is to prevent defects formed between the spray coating layer and the base material at the ends of the groove thereby preventing lowering of adhesion. The groove angle 33 is preferably within a range of 15 to 45°. The numeral 31 denotes a shaft diameter.

Figure 6:
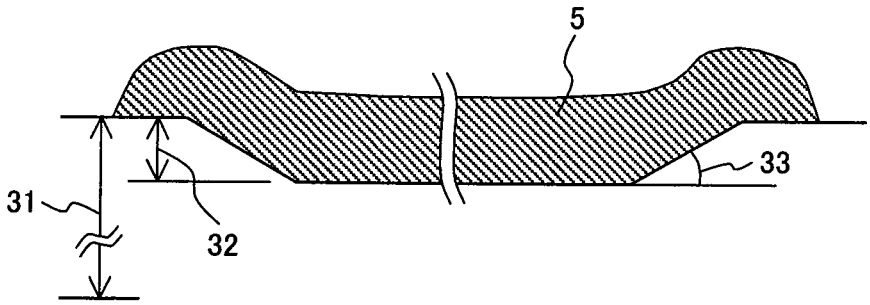
FIG. 6 is a second step of the coating method of the low alloy steel according to the present invention.

Next, the surface including the groove to be treated was subjected to de-fatting treatment, followed by surface-roughening treatment by a blasting treatment using aluminagrit. Thereafter, The spray powder of a low alloy steel having a composition of 1.3% of Cr—0.5% of Mo, the balance being Fe and having a particle size of 25 to 63 μm was sprayed with a HVOF apparatus (manufactured by TAFA) on the surface of the 12% Cr mother material. The resulting coating layer 5 had a thickness of about 1 mm larger than the groove depth 33, as shown in FIG. 6. The numeral 31 denotes a shaft diameter and 33 an inclined angle.

The spray conditions were as follows:

A fuel flow rate; 23 L/hr

An oxygen flow rate; 873 L/hr,

A combustion pressure; 0.7 MPa,

A powder supply rate; 60 g/min.,

A barrel length; 100 mm (4 inches), and

A spray distance; 380 mm.

Figure 2:
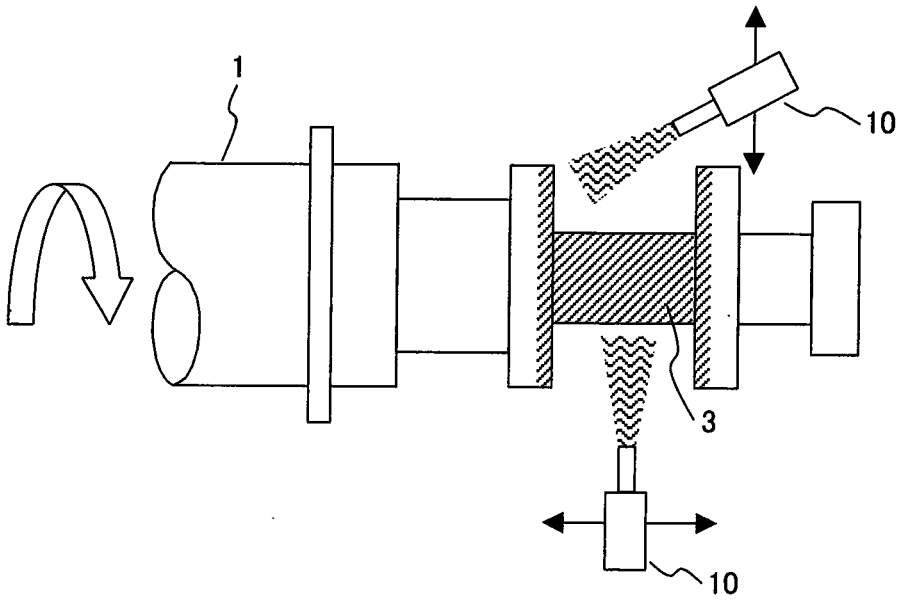
FIG. 2 is a schematic view of a spray coating method applied to the turbine rotor according to the present invention.

While rotating the turbine rotor 1, as shown in FIG. 2, the spray gun 10 was moved substantially parallel with the sliding surface 3 to be sprayed at a relative speed of 200 to 750 mm/sec between the spray gun 10 and the surface.

A cross sectional structure of the low alloy steel coating layer on the 12% Cr heat resisting steel obtained in substantially the same conditions as above was observed and the defect rate was measured by the image analysis. The area rate of the defects was about 10%.

According to the JIS H 8402: 2004 "Test methods of tensile adhesive strength for thermal-sprayed coatings", the tensile adhesion strength was measured. As a result, a value was not measured because breakage took place at the adhesive, but the adhesion strength should be 70 MPa or higher because the strength of the adhesive was about 70 MPa.

Figure 7:
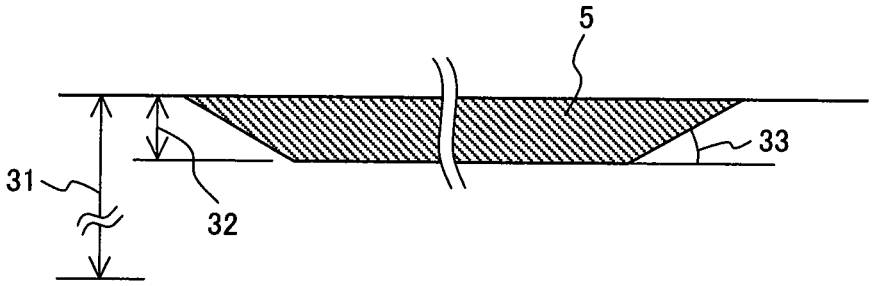
FIG. 7 is a third step of the coating method of the low alloy steel according to the present invention.

After the spray coating, as shown in FIG. 7, the spray coating was finished by machining and polishing to be a predetermined diameter 31. The numeral 5 denotes the low alloy steel coating layer, numeral 32 a depth of the groove, and numeral 33 an inclination angle.

As is described above, the 12% Cr heat resisting steel shaft 23 having the low alloy element coating layer 5 on the journal 25 was installed in the testing apparatus shown in FIG. 4 to conduct the bearing test.

For comparison, tests on the 12% Cr heat resting steel shaft having no coating and the 12% Cr heat resisting steel having the conventional deposit welding layer were conducted.

The test conditions were as follows. The shaft was rotated at a circumferential speed of 50 m/sec under a bearing load of 30 kg/cm$^2$, iron powder having a particle size of 125 to 300 μm was added as foreign matter to a lubricant at a rate of about 1 g/min for ten minutes so as to investigate damage of the shafts and bearings. In addition, temperatures of the bearing metals in the tests were measured. When lubrication is degraded by lubricant loss between the shaft and the bearing metal, which may be caused by inclusion of the foreign matter, the temperature elevates by friction between the metals. The lower the temperature rise of the bearing metal, the better the sliding characteristics achieved.

Figure 8:
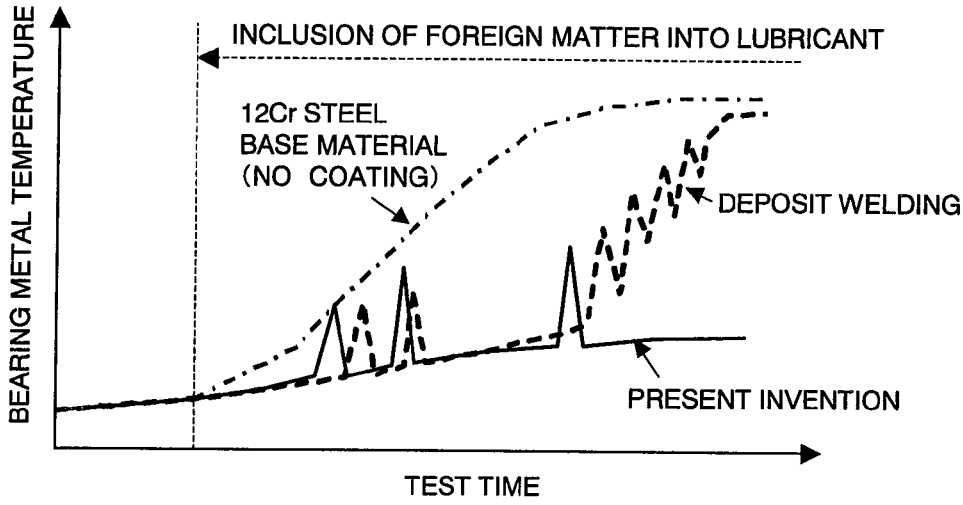
FIG. 8 is a graph showing a relationship between a test period time and a temperature of the bearing.

FIG. 8 shows a temperature change of the bearing metal during the test. The test of the 12% Cr heat resisting steel shaft provided with the low alloy steel coating layer showed a sudden temperature rise after inclusion of the foreign matter was observed, but it lowered within a short period of time. The temperature in the stable period was reached about 80° C.

On the other hand, in the case of the 12% Cr heat resisting steel rotor shaft having no coating of the low alloy steel, the temperature continuously increased to and stabilized at about 200° C. after inclusion of the foreign matter.

In the case that the conventional deposit welding layer was formed on the journal of the 12% Cr heat resisting steel, after the foreign matter inclusion, the sudden temperature rise was observed for a while and lowered within a short period of time the same as in the shaft of the present invention. However, in the later part of the test of the conventional 12% Cr heat resisting steel shaft having the deposit welding layer, the temperature continuously elevated to arrive at about 200° C. the same as the shaft having no low alloy steel coating layer.

The damaged states of the shafts and the bearing metals after the tests were observed by eye. As a result, in the case of the 12% Cr heat resisting steel shaft having the low alloy steel coating layer, only slight scratches were observed in the sliding faces of the shaft made of 12% Cr heat resisting steel having the low alloy steel coating layer and it was not damaged. However, the bearing was damaged.

On the other hand, in the cases of the 12% Cr heat resisting steel rotor shaft having no low alloy steel and the 12% Cr heat resisting steel having the deposit welding coating layer, there were observed many thread-like scratches in the sliding faces of the shafts. Generation of wire wool foreign matter was observed. The bearing metals were heavily damaged.

As has been described, the rotor made of the 12% Cr heat resisting steel having the low alloy steel coating layer exhibited remarkably improved bearing characteristics, compared with the 12% Cr heat resisting steel shaft having no low alloy steel coating layer. Further, it was revealed that the bearing characteristics of the shaft of the present invention were superior to the conventional deposit welding coating layer.

Example 2

Figure 9:
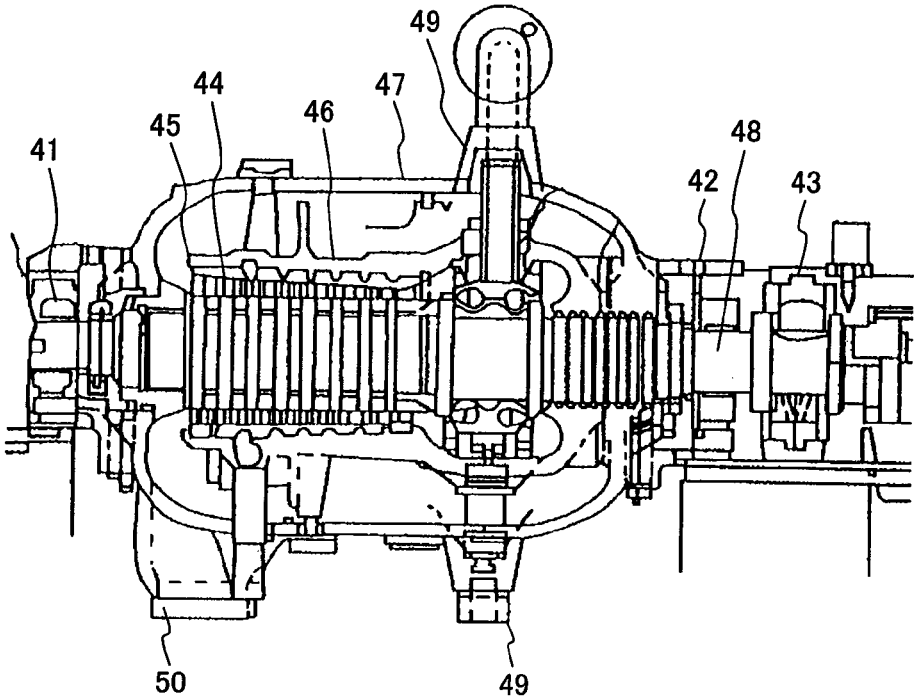
FIG. 9 is a schematic view of a high pressure steam turbine having the turbine rotor shaft to which the present invention was applied.

FIG. 9 shows a schematic cross-sectional view of a high pressure stem turbine comprising a turbine rotor shaft 48 made of 12% Cr heat resisting steel (12% of Cr—2.6% of W—0.2% of Mo—2.5% of Co—0.5% of Ni—0.5% of Mn—0.2% V—0.05% of Si—0.1% of C—0.01% of Nb—0.03% of N—0.02% of B, the balance being Fe), a high pressure partition plate 44, a high pressure blade 45, a high pressure inner nozzle 46, a high pressure outer nozzle 47, a main steam entrance port 49, a steam discharge port 50, etc.

The low alloy steel coating layers of the present invention were applied to sliding sections of a first bearing 41, second bearing 42 and thrust bearing 43 disposed to the turbine rotor shaft 48.

The process of forming the coating layer was the same as in Example 1. At first, a groove was formed having a depth of 3 mm prior to the process. Both ends of the beveling had inclination angle of 30°. Next, the surface including the groove to be processed was subjected to de-fatting, followed by roughening treatment by blasting with alumina grid. Thereafter, the low alloy steel coating layer was formed using spray powder of the low alloy element powder (1.3% of Cr—0.5% of Mo, the balance being Fe) on the surface having a thickness of about 1 mm larger than the depth of the groove by means of the JP5000 type HVOF apparatus (manufactured by TAFA).

The spray conditions were as follows:

A fuel flow rate; 23 L/hr

An oxygen flow rate; 873 L/hr,

A combustion pressure; 0.7 MPa,

A powder supply rate; 60 g/min.,

A barrel length; 100 mm (4 inches), and

A spray distance; 380 mm.

While rotating the turbine rotor 1, as shown in FIG. 2, the spray gun 10 was moved substantially parallel with the sliding surface 3 to be sprayed at a relative speed of 200 to 750 mm/sec between the spray gun 10 and the surface.

The high pressure steam turbine that utilized the turbine rotor shaft 48 having the sliding bearing to which the low alloy steel coating layer was applied was operated for one year. The sliding bearing of the turbine rotor shaft 48 of the high pressure steam turbine was inspected after the one year operation. It was found that the sliding bearing and the bearing metal were both sound.

INDUSTRIAL APPLICABILITY

The present invention can improve durability of the bearing of the steam turbine rotor shaft.

What is claimed is:

1. A steam turbine rotor made of 9 to 13% wt Cr heat resisting steel, having a sliding surface of a journal is provided with a coating layer of a low alloy steel containing Cr of 0.5 to 2.5 wt %, Mo of 0.4 to 1.1 wt % and the balance being Fe wherein the coating layer is obtained by a high velocity flame spray (HVOF) method and the coating layer has an area ratio of defects including pores and oxides which contain Fe oxides in an arbitrary cross sectional structure of 3 to 15%.

2. The steam turbine rotor according to claim 1, wherein a thickness of the coating layer of the low alloy steel is 0.5 to 5 mm.

3. The steam turbine rotor shaft according to claim 1, wherein the coating layer of the low alloy steel has an adhesion-strength of 40 Mpa or more.

* * * * *